US005518475A

United States Patent [19]

Garland

[11] Patent Number: 5,518,475

[45] Date of Patent: May 21, 1996

[54] BABY WALKER

[76] Inventor: Thomas A. Garland, 76 Reservoir Cir., Jamestown, R.I. 02835

[21] Appl. No.: 425,285

[22] Filed: Apr. 20, 1995

[51] Int. Cl.[6] ..... A63B 22/20

[52] U.S. Cl. ..... 482/68; 482/66

[58] Field of Search ..... 482/68, 66, 69

[56] References Cited

U.S. PATENT DOCUMENTS

| | | | |
|---|---|---|---|
| 432,378 | 7/1890 | Davidson . | |
| 1,141,123 | 5/1915 | Knight . | |
| 1,204,249 | 11/1916 | Condon . | |
| 2,198,813 | 4/1940 | Hall . | |
| 2,665,742 | 1/1954 | Starysky . | |
| 2,697,478 | 12/1954 | McKinney . | |
| 2,910,111 | 10/1959 | Hansburg . | |
| 3,183,028 | 5/1965 | Williams . | |
| 3,504,927 | 4/1970 | Seki | 482/68 |
| 5,302,163 | 4/1994 | Fermaglich et al. . | |

*Primary Examiner*—Lynne A. Reichard
*Attorney, Agent, or Firm*—Fish & Richardson

[57] ABSTRACT

Apparatus for moving within a region includes a base, a tray and a plurality of legs intercoupling the base and the tray. The tray carries a seat and is constructed and arranged so that a person sitting in the seat may use foot power to translate in any direction within a predetermined region and rotate.

12 Claims, 7 Drawing Sheets

BABY WALKER

The present invention relates in general to moving in a fixed base and more particularly concerns novel apparatus and techniques that allows a child to walk or move within a fixed base in any direction. Movement may be along a straight line, along a random or curved path, circular, rotary or otherwise.

BACKGROUND OF THE INVENTION

A search of subclass 67 of class 135 and subclasses 5, 137.1, 275, 344.21 and 344.26 of class 297 uncovered U.S. Pat. Nos. 432,378, 1,204,249, 1,141,123, 2,198,813, 2,665,742, 2,697,478 and 3,183,028. U.S. Pat. No. 5,302,163 discloses an infant exerciser adapted for use in a stationary location having a frame and infant seat attached to the frame such that the seat can be revolved in an orbital manner and rotate about its own axis of rotation, whereby an infant who is in the seat can walk along a circular path and/or turn in place.

SUMMARY OF THE INVENTION

According to the invention, there is a stationary base and movable structure such as a tray, which may be formed with a track. A plurality of legs intercouple the tray and base and support the tray at predetermined height above the base. The apparatus is constructed and arranged to allow the tray to translate and rotate in any direction in the horizontal plane relative to the fixed base within a predetermined area while the base remains stationary upon the supporting surface. Each leg may be rotatably supported at the end adjacent to the base. The tray supports a seat that may correspondingly translate and rotate. According to a specific aspect of the invention, the top of each leg is connected to rollers that reside in the tray track. An embodiment of the invention resides in having legs that can be adjusted downward to allow the tray to nest within the base to facilitate storage and shipment and upward to establish a desired height of the tray above the base.

Numerous other features, objects and advantages of the invention will become apparent from the following detailed description when read in connection with the accompanying drawing in which:

DETAILED DESCRIPTION

Figure 1:
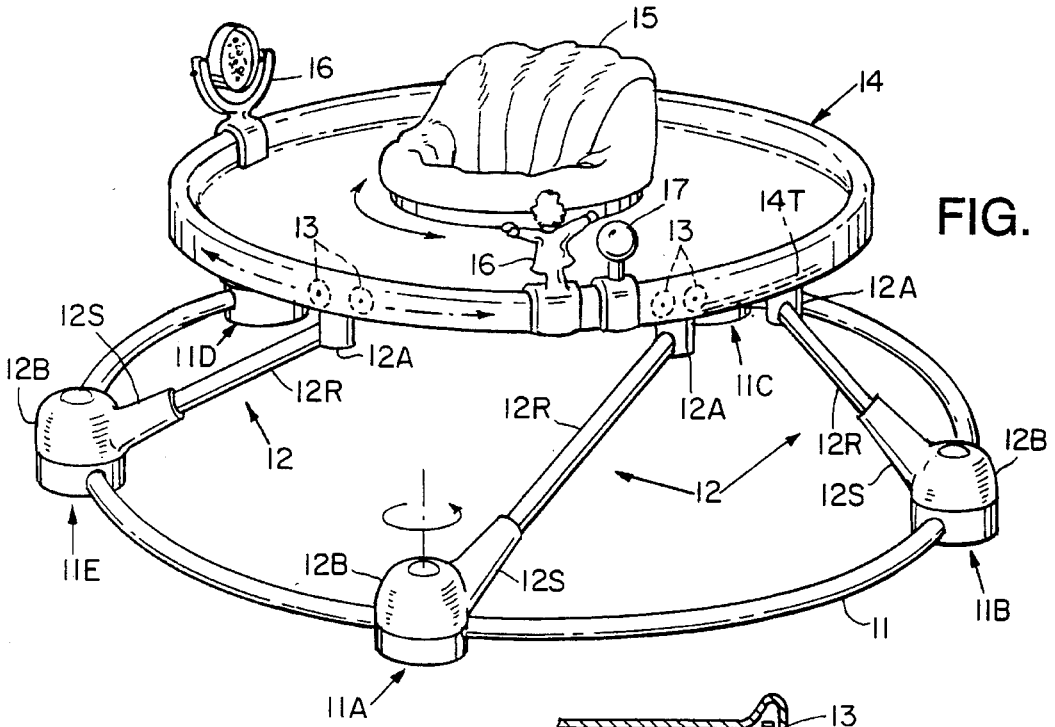
FIG. 1 is a perspective view of an embodiment of the invention having a circular base.

With reference now to the drawings and more particularly FIG. 1, there is shown a perspective view of an embodiment of the invention having a circular base. A circular tubular base 11 supports five legs at equiangularly spaced points 11A, 11B, 11C, 11D and 11E. Each leg 12 is pivotally mounted at the base by joint 12B formed with a sleeve portion 12S that accommodates a rod 12R. The top of each rod 12R supports a roller assembly 12A having rollers 13 that ride in a peripheral track 14T at the periphery or perimeter of tray 14 that supports the tray at a predetermined height determined by the elevation angle of legs 12 relative to the plane of base 11 while allowing the tray to rotate completely about its vertical axis and translate within any direction within base 11 and beyond in an area limited and defined by base joint pivot angle stops in each joint 12B These stops limit the pivot angle through which legs 12 may swing and thus the area of travel of tray 14 and seat 15. Tray 14 carries a swivel seat 15 for supporting an occupant, typically a small child, whose legs may preferably rest within the area bounded by base 11, allowing the occupant to translate and rotate in any direction preferably within the area bounded by base 11. Although it may be desirable to limit the extent of the travel area to keep the occupant's feet within base 11, the geometry of base 11 does not uniquely determine the extent of travel. Toys, such as 16, may be attached to the edge of tray 14 with a handle, such as 17. Increasing the elevation angle of legs 12 relative to, and in a plane preferably normal to the plane of base 11, raises tray 14 to predetermined height typically between 13 to 16 inches, while decreasing this elevation angle toward zero lowers tray 14 for essentially flat storage within base 11.

The invention may include a bounce feature, for example, by spring loading rollers 13 or other elements associated with legs 12, or mounting swivel seat 15 with spring support.

Figure 2:
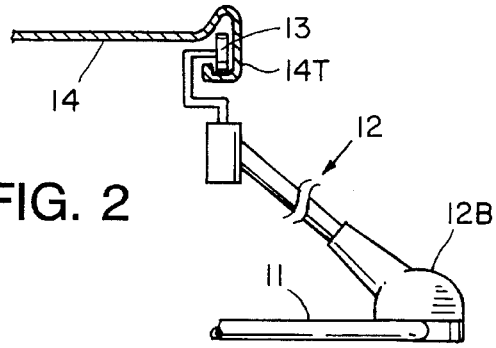
FIG. 2 is a fragmentary diagrammatic elevation view illustrating the relationship among a leg, roller and peripheral tray track.

Referring to FIG. 2, there is shown a fragmentary diagrammatic view illustrating the relationship between rollers 13, track 14T and leg 12.

Figure 3:
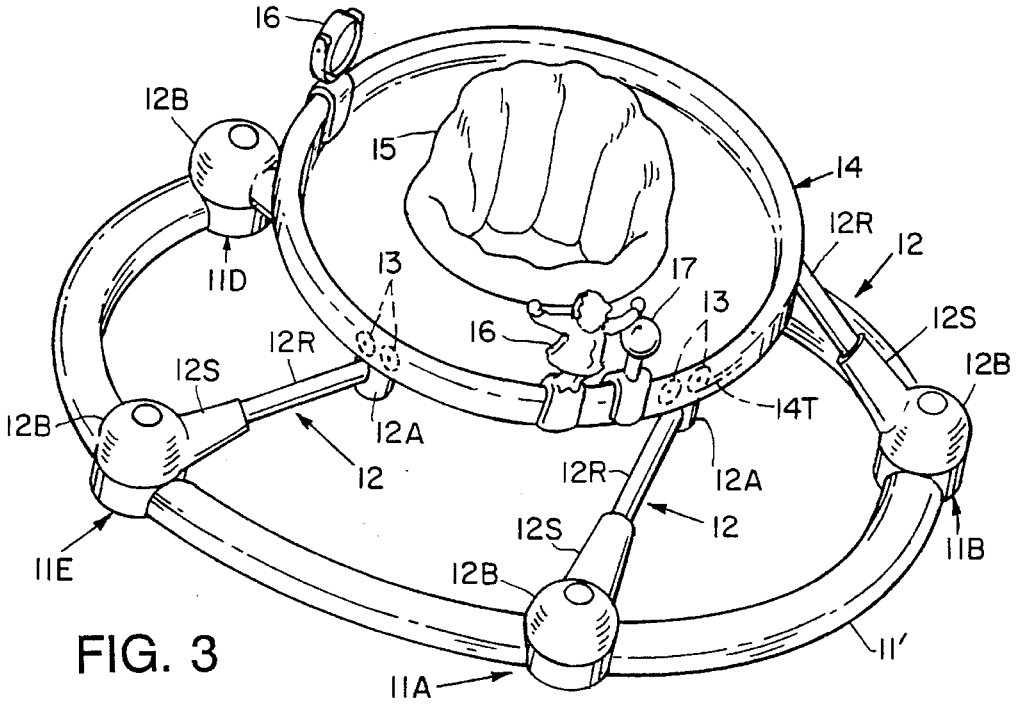
FIG. 3 is a perspective view of an embodiment of the invention having an oval base.

Referring to FIG. 3, there is shown a perspective view of another embodiment of the invention having an oval base 11'. Corresponding elements are identified by the same reference numerals throughout the drawing.

Figure 4:
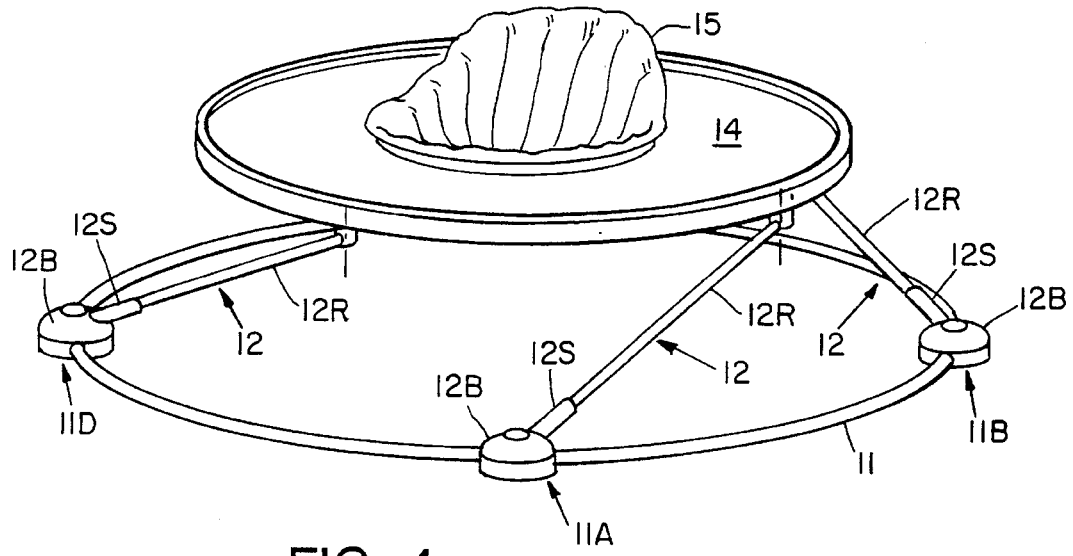
FIG. 4 is a diagrammatic perspective view of an embodiment of the invention with four legs helpful in understanding the mode of operation.
Figure 5:
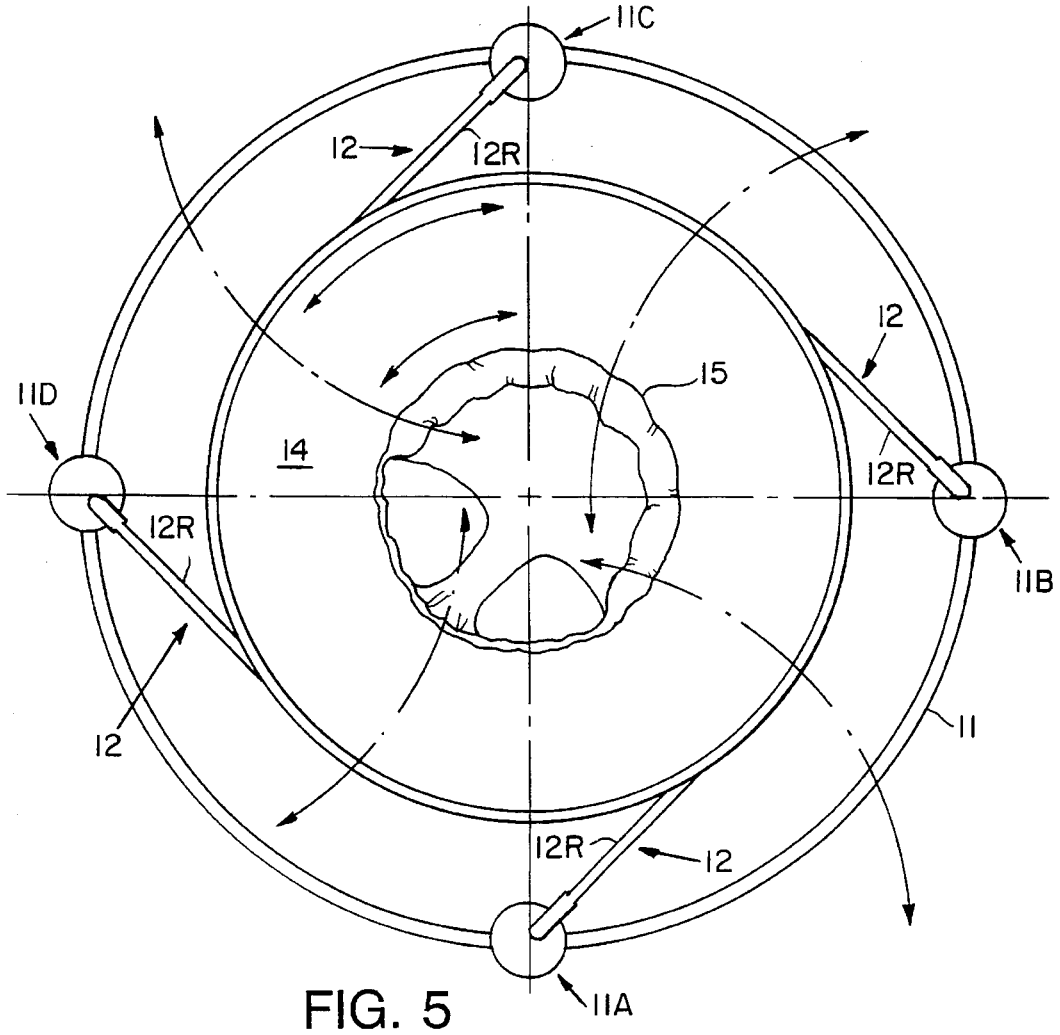
FIG. 5 is a plan view of the embodiment of FIG. 4.

Referring to FIGS. 4 and 5, there are shown diagrammatic perspective and plan views, respectively, of another embodiment of the invention in which four legs attached to base 11 at points in space quadrature support tray 14.

Figure 6:
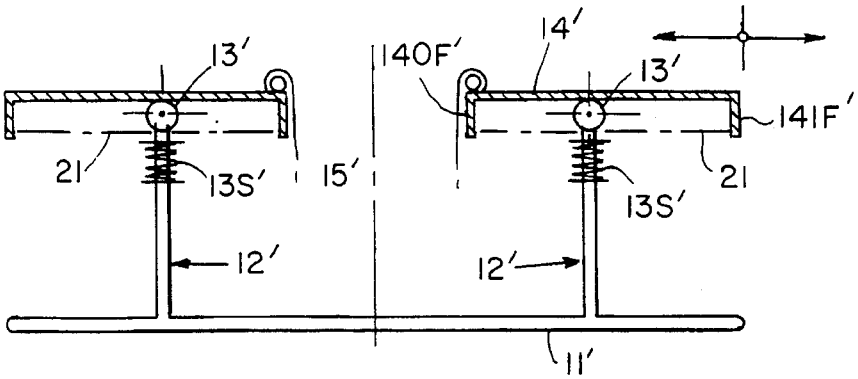
FIG. 6 is a diagrammatic view of an alternate embodiment of the invention with casters at the top of the legs supporting the tray.

Referring to FIG. 6, there is shown an elevation view of a diagrammatic representation of an alternate embodiment of the invention with a bounce option comprising legs 12' attached to fixed base 11' having swivel casters 13' at the top spring loaded by springs 13S' above retainer 21 allowing tray 14' to translate and rotate.

Figure 7:
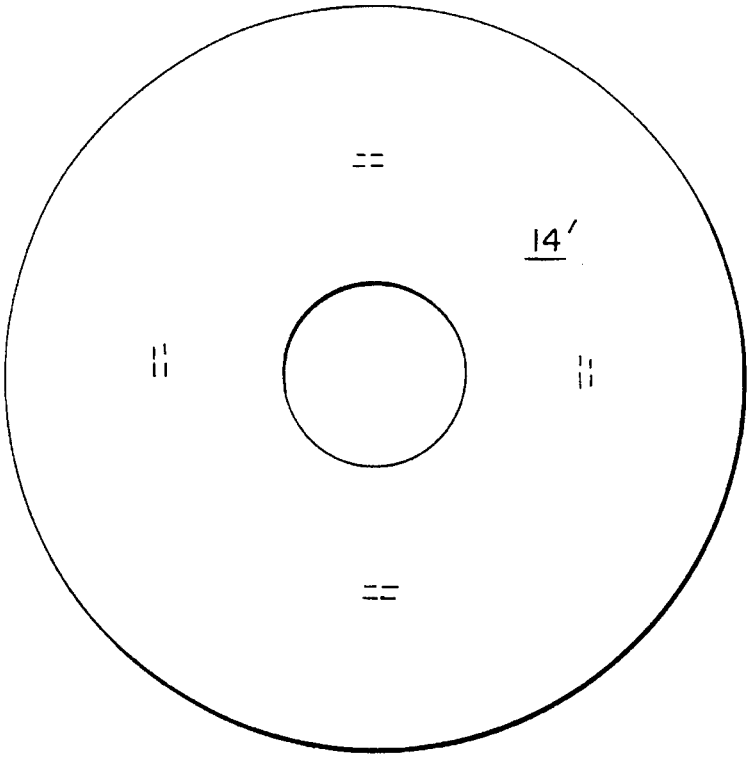
FIG. 7 is a diagrammatic representation in plan of the embodiment of FIG. 6.

Referring to FIG. 7, there is shown a plan view of tray 14'.

Figure 8:
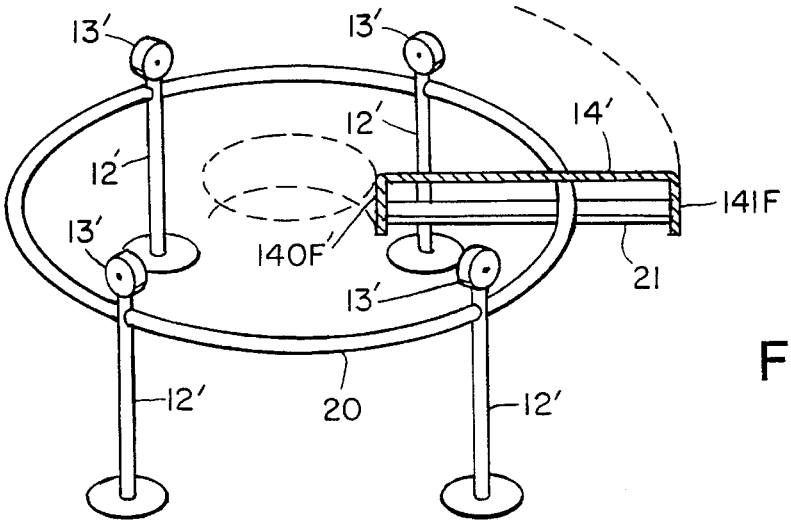
FIG. 8 is a perspective view of the embodiment of FIG. 6 with tray removed.

Referring to FIG. 8, there is shown a diagrammatic perspective view showing retainer bar 20 formed in a circle and welded to the top portion of each of the four legs 12', thereby forming a fixed base structure. The top of each leg supports a swivel caster 13'. Casters 13' support tray 14' so that tray 14' is free to move in any direction or rotation, constrained only by the stops formed by the inner and outer depending flanges 14IF' and 14OF' of tray 14'. Two retainers 21 and 21' are connected between the inner and outer underside flanges 14IF' and 14OF' of tray 14' below retainer bar 20, thereby preventing tray 14' and the retainer assembly from lifting off the supporting casters 13'. With two retainers 21 and 21' mounted at 0° and 180° around the underside of tray 14', the retainers allow only about 90° of tray rotation before the retainers hit one of the legs. Full rotation ability can be accomplished by mounting each end of a retainer 21' in a circular and rotary track 22 so that the retainer 21' can rotate about the central axis of the tray upon hitting a leg as shown in the diametrical sectional elevation view in FIG. 9.

Figure 9:
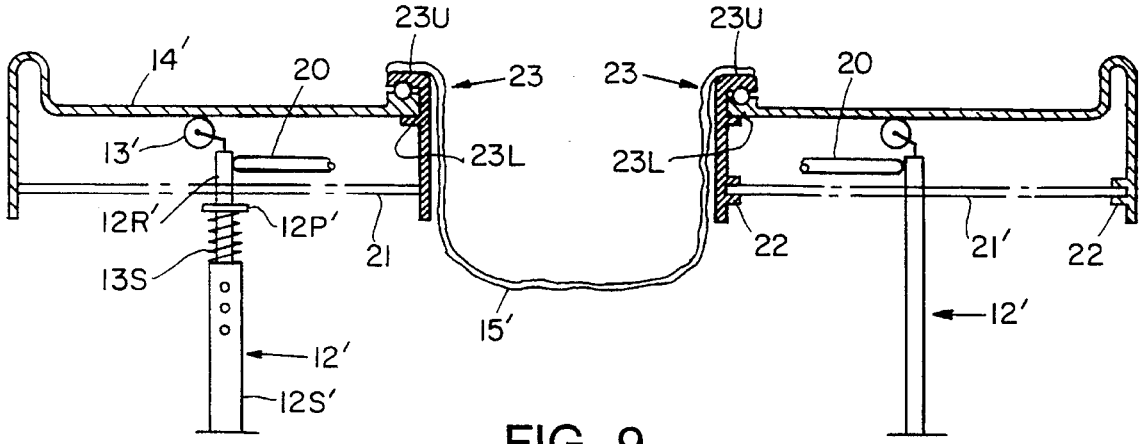
FIG. 9 is an elevation view of the embodiment of FIG. 6.

FIG. 9 also shows spring 13S' for providing an optional spring bounce feature with leg 12' comprising a hollow sleeve 12S' accommodating a rod 12R' with spring 13S' between the top edge of sleeve 12S' and a pin 12P' in rod 12R'. A fabric seat 15' may be supported on a seat bearing brace and fabric support 23U of ball bearing 23 with the lower brace 23L on the upper inside edge of tray 14'.

Figure 10:
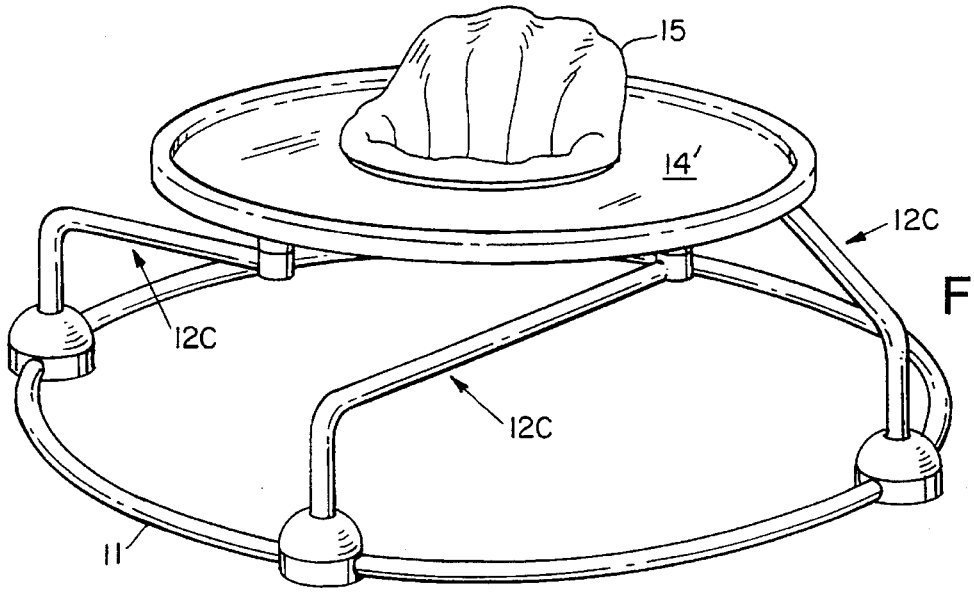
FIG. 10 is a diagrammatic perspective view of still another embodiment of the invention having bent legs.

Referring to FIG. 10, there is shown a diagrammatic perspective view of another embodiment of the invention in which swivel casters/rollers on bent or curved legs 12C support the underside of tray 14'.

Figure 11:
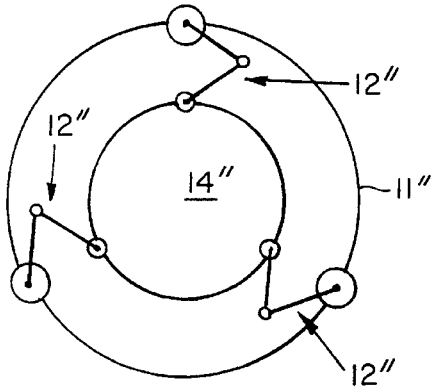
FIG. 11 is a plan view of still another embodiment of the invention using two-part swivel arms.

Referring to FIG. 11, there is shown a diagrammatic plan view of another embodiment using two-part swivel arms 12" pivotally connected to tray 14" above base 11".

Figure 12:
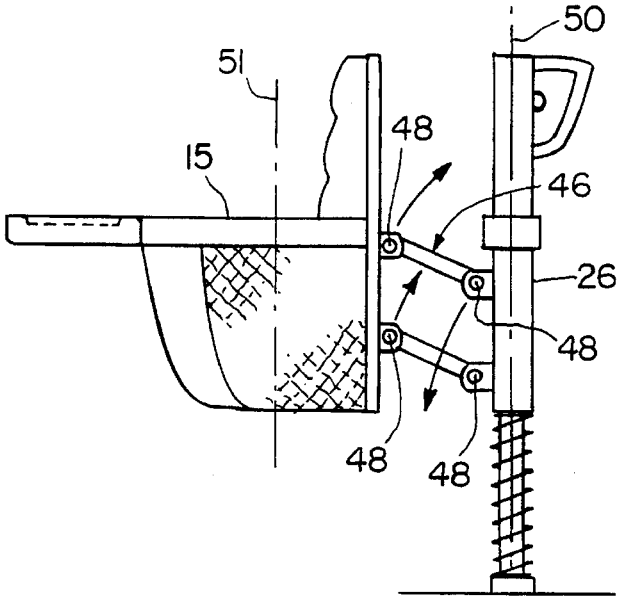
FIG. 12 is an elevation view of a seat assembly using parallelogram linkage support means.
Figure 13:
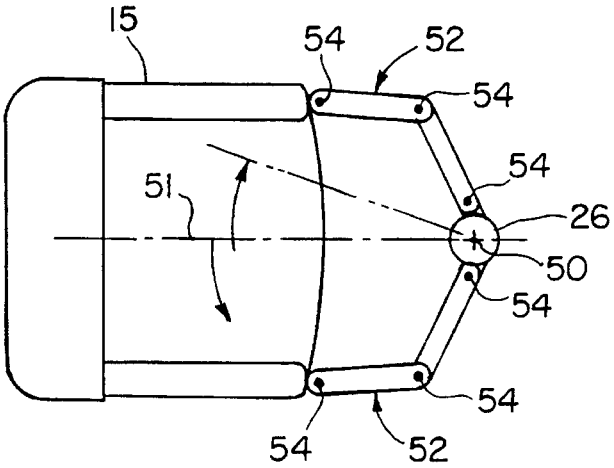
FIG. 13 is a plan view of still another seat assembly using a pair of linkage assemblies.
Figure 14:
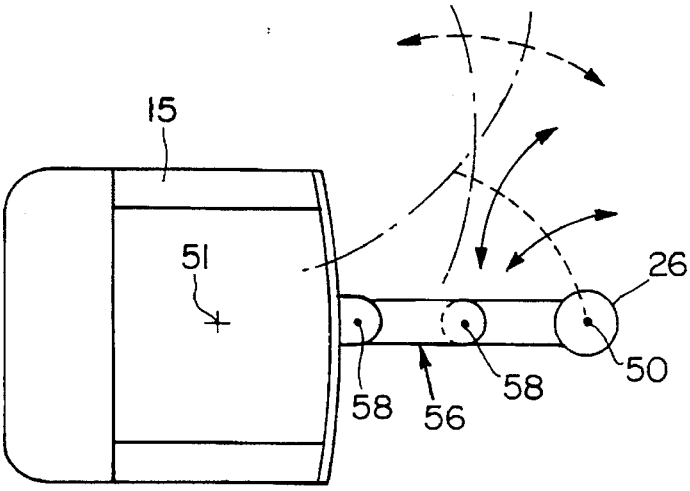
FIG. 14 is a plan view of still another seat assembly using a single linkage assembly.

Referring to FIGS. 12–14, there is shown an elevation view of a spring loaded seat support in FIG. 12. FIG. 13 shows a diagrammatic plan view of a means for supporting the seat with two pairs of linkages connected to the side of the seat. FIG. 14 shows an alternative arrangement for supporting the seat with a single linkages connected to the center of the chair.

In the embodiment shown in FIG. 12, a parallelogram linkage 46, which includes 4 pin joints 48, connects chair 15 and sleeve 26. The axes of rotation of pin joints 48 are perpendicular to both the center axis of sleeve 26 and the vertical axis 51 of chair 15. The vertical axis 51 is generally parallel to the direction of the gravitational force exerted by a child seated in chair 15. One of pin joints 48 can be locked at any rotational orientation to fix the orientation of linkage 46.

In the embodiment shown in FIG. 13, a pair of linkage assemblies 52, each including three pin joints 54, connects chair 15 and sleeve 26.

In the embodiment shown in FIG. 14, a single linkage assembly 56 having two pin joints 58 connects chair 15 and sleeve 26. The axes of rotation of pin joints 54, 58 are parallel to both the center axis 50 of sleeve 26 and the vertical axis 51 of chair 15. Similar to the embodiment of FIG. 12, one of pin joints 54, 58 is lockable.

In each of the embodiments shown in FIGS. 12, 13 and 14, the position of chair 15 with respect to sleeve 26 may be fixed either by fixing the position of one or more of the links of linkages 46, 52, 56 with respect to sleeve 26 or chair 15, or by locking the lockable pin joint 48, 54, 58.

Figure 15:
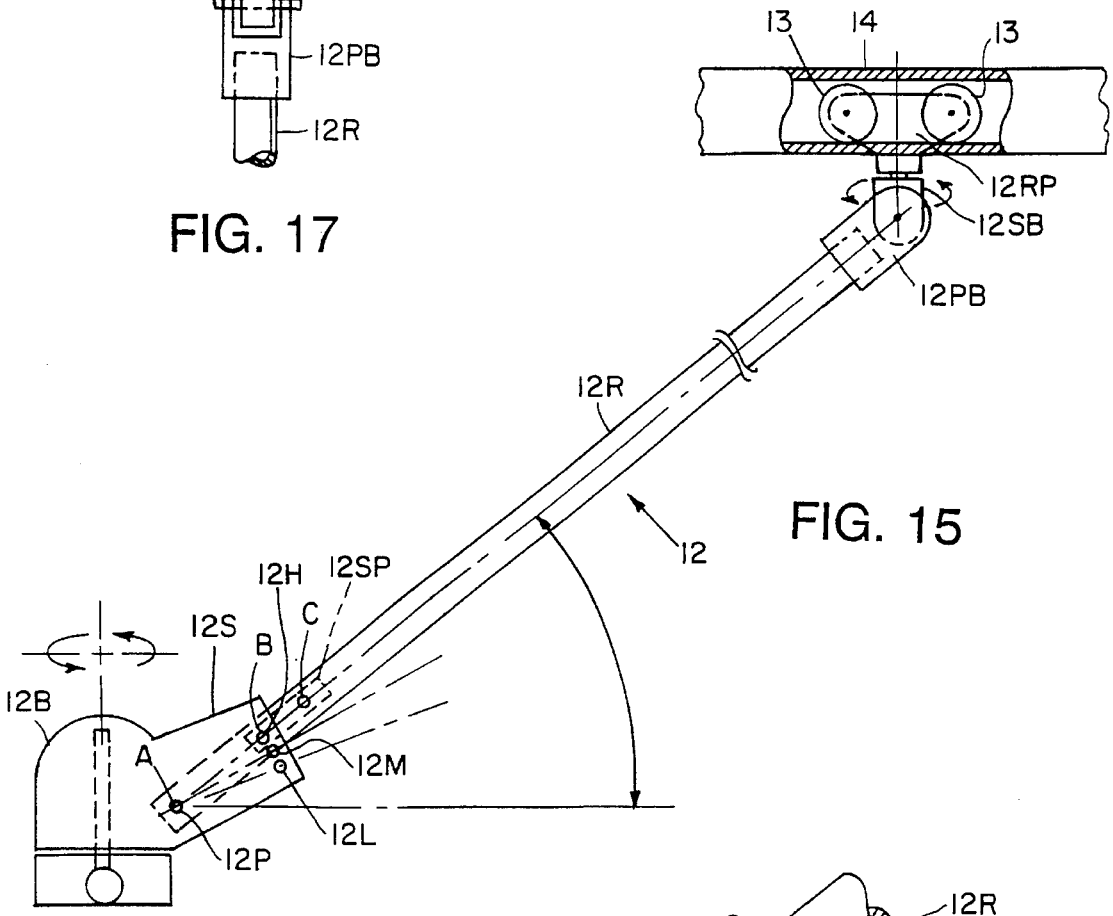
FIG. 15 is a fragmentary diagrammatic elevation of the embodiment of FIG. 1 showing a leg and its attachment to the tray and base.

Referring to FIG. 15, there is shown a fragmentary elevation view illustrating details of how leg 12 may be adjusted among low, high, and medium positions by pivoting about pivot point 12P in swivel joint 12B with the elevation angle set by a spring pin 12SP engaging one of low, medium and high holes 12L, 12M and 12H, respectively.

Figure 16:
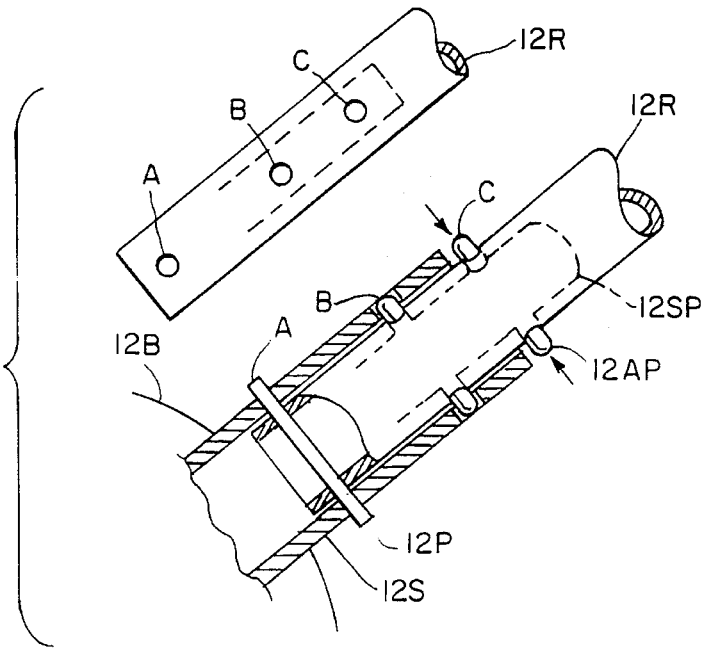
FIG. 16 is a fragmentary diagrammatic elevation of the embodiment of FIG. 1 showing the tray height adjustment means.

Referring to FIG. 16, there is shown a detail of how rod 12R may be made hollow to surround lower portion 12P whereby pressing pin 12AP allows height adjustment and flat folding.

Figure 17:
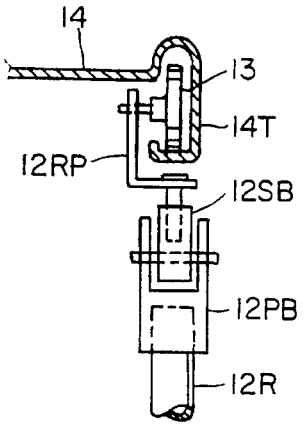
FIG. 17 is a fragmentary diagrammatic elevation of the embodiment of FIG. 1 showing the top of a leg and the roller engagement with the track.

Referring to FIG. 17, there is shown a diagrammatic representation of details showing how the upper portion of leg 12 carries a pivot block 12PB that carries a swivel block 12SB that. in turn supports roller mounting plate 12RP that accommodates roller 13.

Figure 18:
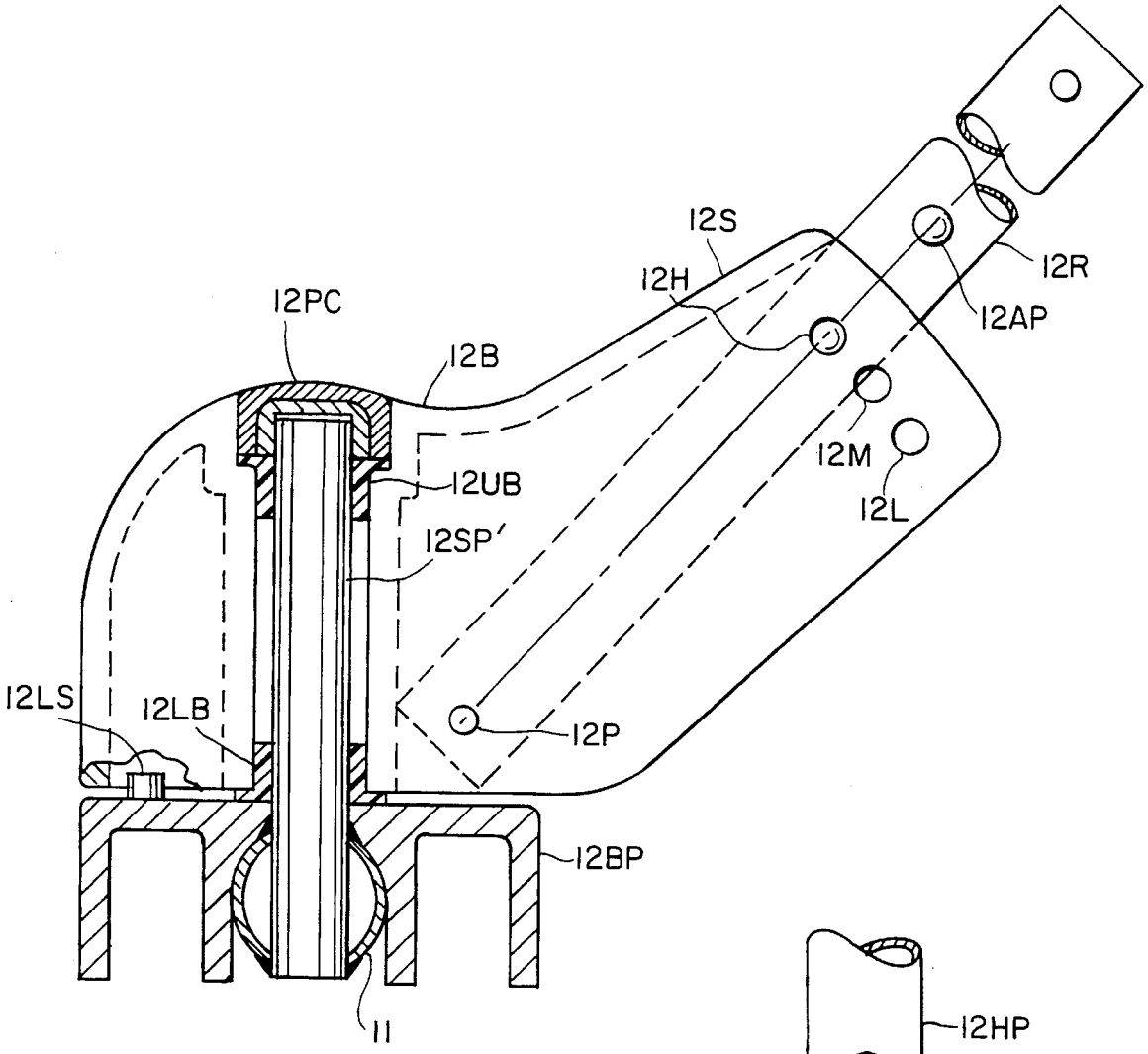
FIG. 18 is a diagrammatic elevation of the embodiment of FIG. 1 showing a swivel base, fixed base and leg.

Referring to FIG. 18, there is shown a diagrammatic representation of the relationship among swivel base 12B, rod 12R and fixed base tube 11. Typically there is a ½" solid steel post 12SP' welded to both sides of a hole punched in fixed base tube 11 that accommodates upper and lower delrin bearings 12UB and 12LB and is covered by plastic cap 12PC. There is a base plate 12BP that carries a lower stop 12LS with an upper stop 12US attached to the pivoting member 12PM of swivel base 12B to limit angular azimuth motion between predetermined limits typically related to keeping the feet of the occupant within base 11.

Figure 18A:
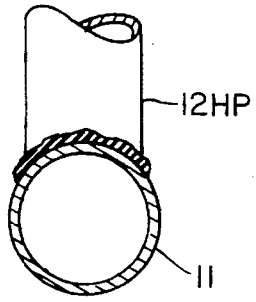
FIG. 18A is a diagrammatic elevation of the embodiment of FIG. 1 showing an alternate swivel construction.

Referring to FIG. 18A there is an alternative arrangement showing instead of solid steel post 12SP', a hollow post 12HP welded at its base to the top of hollow base tube 11.

Other embodiments are within the claims.

What is claimed is:

1. Apparatus for moving within a predetermined region comprising, a fixed base constructed and arranged to remain stationary upon a supporting surface, a movable structure, a plurality of legs intercoupling said movable structure and said base, said apparatus constructed and arranged to allow at least translation of said movable structure in any direction relative to said fixed base in a substantially horizontal plane while said fixed base remains stationary on a supporting surface.

2. Apparatus in accordance with claim 1 wherein said apparatus is constructed and arranged to also allow rotation of said movable structure about a vertical axis.

3. Apparatus in accordance with claim 1 and further comprising a seat in said movable structure.

4. Apparatus in accordance with claim 3 wherein said seat is rotatably supported in said movable structure.

5. Apparatus in accordance with claim 1 wherein said legs are rotatably connected at one end to said base at points spaced around said base and at the other end to said movable structure, said legs constructed and arranged to rollably support said movable structure to allow rotation of said movable structure about a vertical axis.

6. Apparatus in accordance with claim 5 and further comprising a swivel joint rotatably connecting said one end to said base.

7. Apparatus in accordance with claim 6 wherein said swivel joint is constructed and arranged to selectively support said leg in a plurality of positions corresponding to different selected heights of said movable structure relative to said base.

8. Apparatus in accordance with claim 1 wherein said legs are fixed at one end to said base and further comprising, swivels at the other end of each leg supporting said movable structure.

9. Apparatus in accordance with claim 8 and further comprising retainer structure constructed and arranged to restrict radial movement of said movable structure between predetermined limit radii.

10. Apparatus in accordance with claim 9 wherein said retainer structure includes a retaining bar for preventing lifting off said movable structure from said legs.

11. Apparatus in accordance with claim 1 and further comprising, retainer structure constructed and arranged to restrain radial movement of said movable structure between predetermined limit radii.

12. Apparatus in accordance with claim 11 wherein said retainer structure includes a retaining bar for preventing lifting off said movable structure from said legs.

* * * * *